US006588482B2

(12) United States Patent
Wright

(10) Patent No.: US 6,588,482 B2
(45) Date of Patent: Jul. 8, 2003

(54) CABLE ATTACHMENT BRACKET FOR ARTICULATING GARAGE DOOR PANELS

(75) Inventor: Kevin E. Wright, Dixon, IL (US)

(73) Assignee: Raynor Garage Doors, Dixon, IL (US)

( * ) Notice: Subject to any disclaimer, the term of this patent is extended or adjusted under 35 U.S.C. 154(b) by 0 days.

(21) Appl. No.: 09/909,312

(22) Filed: Jul. 19, 2001

(65) Prior Publication Data

US 2003/0029580 A1 Feb. 13, 2003

(51) Int. Cl.[7] ..... E05D 15/06
(52) U.S. Cl. ..... 160/193; 160/201; 16/91
(58) Field of Search ..... 160/201, 193, 160/207, 191, 192; 16/91, 97, 102, 107

(56) References Cited

U.S. PATENT DOCUMENTS

| | | | | |
|---|---|---|---|---|
| 857,850 | A | | 6/1907 | Vallone |
| 1,059,981 | A | | 4/1913 | Cross |
| 1,341,068 | A | | 5/1920 | Okun |
| 1,724,995 | A | | 8/1929 | Dautrick |
| 2,008,959 | A | | 7/1935 | Johnson |
| 2,072,514 | A | | 3/1937 | Daniell |
| 2,093,020 | A | | 9/1937 | Norberg |
| 2,291,583 | A | | 7/1942 | Rowe |
| 2,436,006 | A | | 2/1948 | Kaiser |
| 2,442,309 | A | | 5/1948 | Norberg |
| 2,495,672 | A | | 1/1950 | Dautrick |
| 2,525,309 | A | | 10/1950 | Norberg |
| 2,567,763 | A | | 9/1951 | Clark |
| 2,684,846 | A | | 7/1954 | Beall |
| 2,694,214 | A | | 11/1954 | Hammer |
| 2,703,141 | A | | 2/1955 | McKee |
| 3,071,400 | A | | 1/1963 | Bellock |
| 3,090,427 | A | | 5/1963 | Stroup et al. |
| 3,101,776 | A | | 8/1963 | Voris |
| 3,160,200 | A | | 12/1964 | McKee et al. |
| 3,354,934 | A | | 11/1967 | Stansberry |
| 3,412,780 | A | | 11/1968 | Moler |
| 3,548,425 | A | | 12/1970 | Goldstein |
| 3,815,657 | A | | 6/1974 | Malek et al. |
| 4,095,641 | A | | 6/1978 | Olson |
| 4,158,998 | A | | 6/1979 | Clement |
| 5,053,263 | A | | 10/1991 | Krone et al. |
| 5,103,890 | A | | 4/1992 | Cloutier |
| 5,353,473 | A | | 10/1994 | Sherick |
| 5,404,927 | A | | 4/1995 | Bailey |
| 5,495,640 | A | | 3/1996 | Mullet et al. |
| 5,918,660 | A | * | 7/1999 | Crawford et al. ..... 160/201 |
| 6,112,464 | A | | 9/2000 | Grisham et al. |
| 6,263,948 | B1 | * | 7/2001 | Whitley ..... 160/201 |

* cited by examiner

*Primary Examiner*—David M. Purol
(74) *Attorney, Agent, or Firm*—Banner & Witcoff, Ltd.

(57) ABSTRACT

A cable attachment bracket secured to the bottom panel of a multi-paneled garage door to prevent unwanted disconnection of a garage door counterbalancing mechanism from the garage door panel.

5 Claims, 2 Drawing Sheets

CABLE ATTACHMENT BRACKET FOR ARTICULATING GARAGE DOOR PANELS

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to a cable attachment bracket that is constructed and secured to articulating garage door panels in such a way as to prevent unwanted disconnection of the bracket from the garage door panel.

BACKGROUND OF THE INVENTION

Overhead garage doors are commonly constructed from a series of horizontal sections or panels hingedly connected about horizontal axes. The sides of each panel forming the door are typically mounted on a suitable track assembly for movement between a vertical position closing the garage opening, and a horizontal position allowing access to the garage interior. Thus, the sides of each panel typically include projecting rollers that ride in a track on each side of a garage door opening.

Generally, the movement of overhead garage doors between the vertical, closed position and the horizontal, open position is generally augmented by a counterbalancing force. This counterbalancing force is typically created through the use of spring mechanisms employing extension springs or torsion springs attached to lift cables that, in turn, are attached to the bottom of the garage door by a cable attachment bracket. When the garage door is in the vertical, closed position, the extension springs or torsion springs are fully extended and under maximum tension. As the garage door transitions from a vertical, closed position to a horizontal open position, the spring tension pulls upwardly on the bottom of the garage door and effectively reduces the weight of a garage door that must lifted by hand or by the motor of the garage door opener.

A problem with garage doors utilizing counterbalancing spring mechanisms is the potential damage and/or injury resulting from the cable attachment bracket becoming disconnected from the bottom of the garage door while the extension spring or torsion spring is under tension. Specifically, conventional systems for attaching the lift cable to the bottom of the garage door allow the cable attachment bracket to be disconnected from the garage door while the extension spring or torsion spring is under tension. Accordingly, there exists a need for an improved cable attachment bracket that is constructed and secured to the bottom of the garage door so as to prevent unwanted disconnection of the cable attachment bracket from the garage door. The present invention provides a cable attachment bracket that solves this problem.

BRIEF SUMMARY OF THE INVENTION

The cable attachment bracket of the present invention is fixed onto a bottom garage door panel of a multi-paneled overhead garage door. A cable extends from the cable attachment bracket to connect the garage door to the garage door counterbalancing mechanism. The cable attachment bracket of the present invention includes a central plate with inwardly opposed flanges or arms extending from the sides of the plate for engaging the door panel and an outwardly extending stud for engaging the cable. The opposed flanges each contain a retaining notch and an opening for the receipt of a fastening screw or fastening device. The bracket flanges or arms fit through slots in the frame of the door panel and are attached to the frame or stile by fasteners.

The construction of the cable attachment bracket prevents the cable attachment bracket from separating from the garage door panel while an attached lift cable is under tension. That is, the fastening screws pass through openings in the opposed flanges so as to secure the cable attachment bracket to a stile or frame of the bottom garage door panel. The notches in the arms engage the slots in the frame and prevent the cable attachment bracket from becoming separated from the bottom garage door panel in the event the fastening screws are removed. Specifically, when the fastening screws are removed while the lift cable is under tension, the tension in the lift cable biases the retaining notches in the slots of the frame or stile to an interlocked position with the bottom garage door panel or frame. Consequently, the cable attachment bracket cannot be separated from the bottom garage door panel without first releasing the tension in the lift cable. Accordingly, the cable attachment bracket cannot be accidentally disconnected from the garage door while the cable is under tension.

DESCRIPTION OF THE PREFERRED EMBODIMENT

Figure 1:
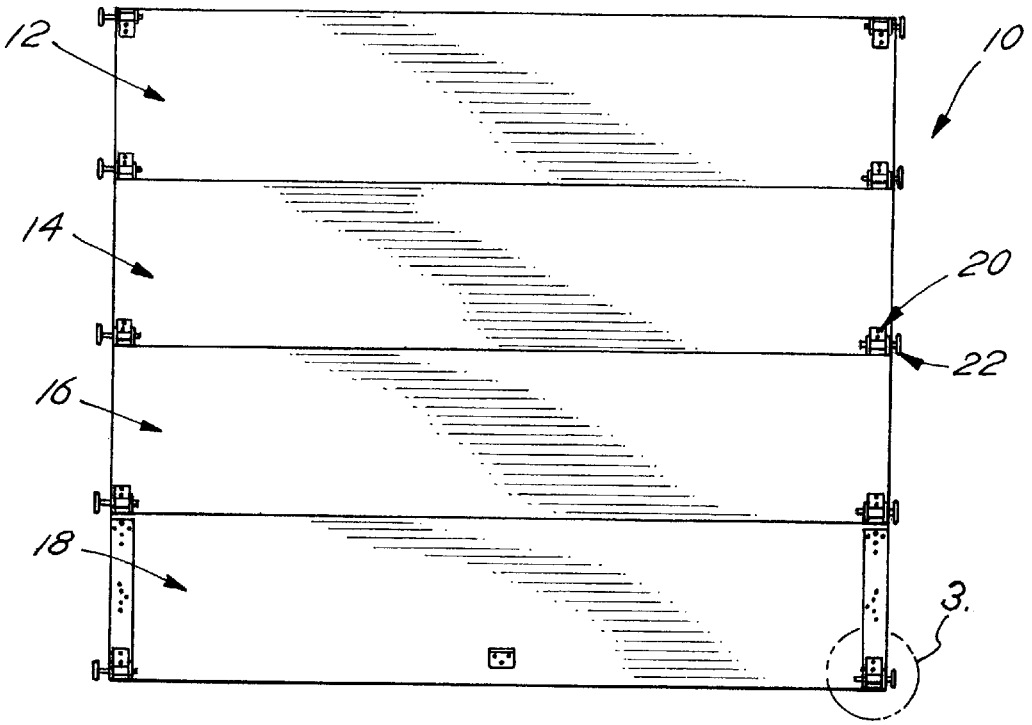
FIG. 1 is a rear elevation of the outer surface of a closed garage door constructed in accordance with the present invention, and depicts a plurality of horizontal adjacent garage door panels.

The present invention relates to a tamper resistant cable attachment bracket for attaching a lift cable to the bottom panel of a multi-paneled overhead garage door. Specifically, the cable attachment bracket of the present invention is constructed and positioned on the garage door in a way that prevents the inadvertent disconnection of the cable attachment bracket from the garage door. Referring to FIG. 1, the present invention is generally utilized on an overhead garage door 10 having a plurality of horizontally, oriented, garage door panels 12, 14, 16, 18. Roller brackets 20 are mounted on laterally opposed ends of the horizontally, oriented garage door panels. The roller brackets 20 support rollers 22 that ride in a track on each side of a garage door opening.

Figure 2:
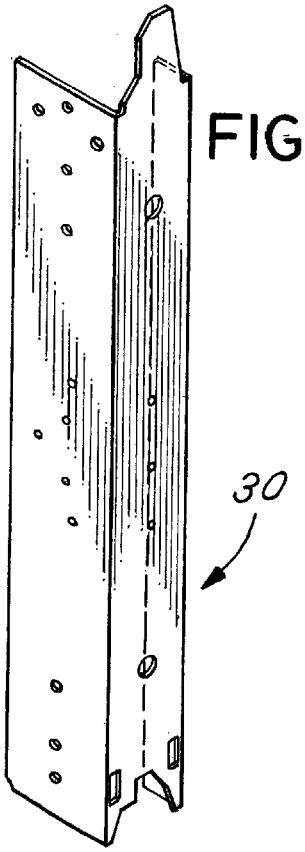
FIG. 2 is an isometric view of an end stile or frame member used with the present invention.
Figure 3:
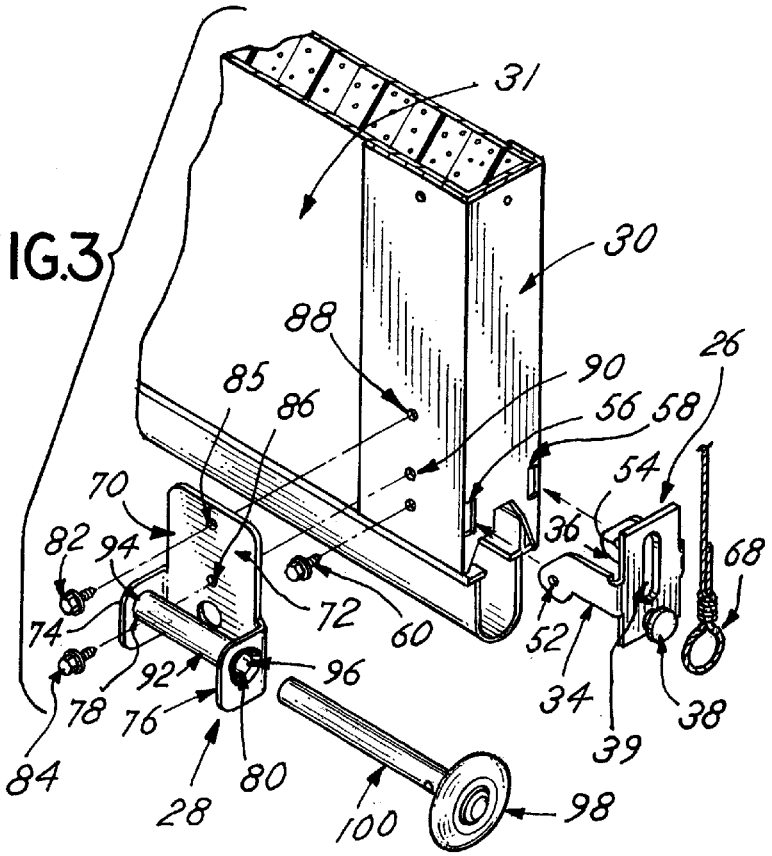
FIG. 3 is an exploded isometric view of an cable attachment bracket assembly and the bottom roller assembly for the present invention.

Referring to FIGS. 2 and 3, a cable attachment bracket 26 and a bottom roller assembly 28 are attached to an end stile or door side frame member 30. In turn, the end stile 30 is attached to a bottom garage door panel 31 of a multi-paneled, overhead garage door. Those of ordinary skill in the art, however, will recognize that the cable attachment bracket 26 and the bottom roller assembly 28 can be directly connected to the bottom panel 31 without use of an end stile 30. That is, the function of the stile 30 may be accomplished by the side construction of the door panel 12. The cable attachment bracket 26 is preferably constructed of aluminum, steel, stainless steel, or other suitable material.

Figure 4:
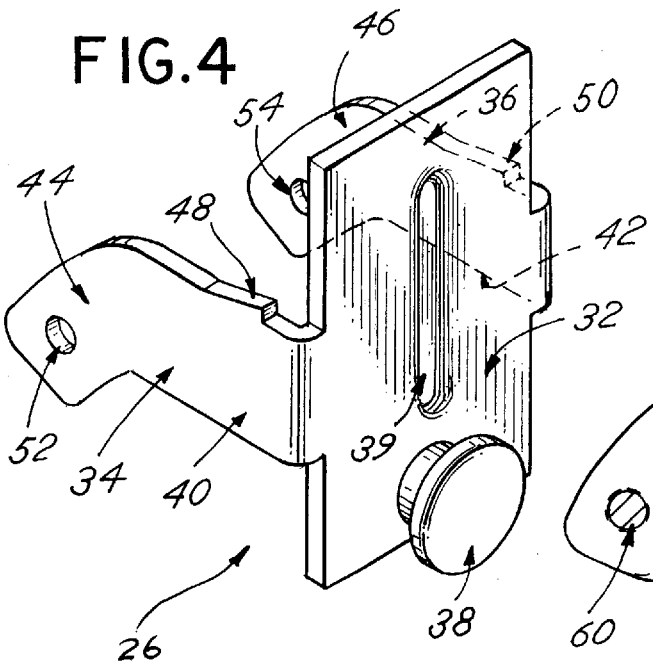
FIG. 4 is an enlarged isometric view of an exemplary embodiment of a cable attachment bracket of the present invention.

Referring to FIG. 4, in an exemplary embodiment of the present invention, the cable attachment bracket 26 has a central plate or member 32, inwardly extending opposed flanges 34, 36, and an outwardly projecting shoulder rivet or stud 38. The central plate 32 contains a recessed channel 39 projecting inwardly from the central plate 32 for receipt of the cable. The opposed flanges 34, 36 have perpendicular runs 40, 42 and angular runs 44, 46. The perpendicular runs 40, 42 contain retaining notches 48, 50. The angular runs 44, 46 contain keyed openings 52, 54 for the passage of a screw, bolt, or other fastening devices. The cable attachment bracket 26 may be molded from steel, aluminum, or other suitable material to form a component part, or alternatively, constructed of multiple pieces of material welded or fused together to form a component part.

Figure 6:
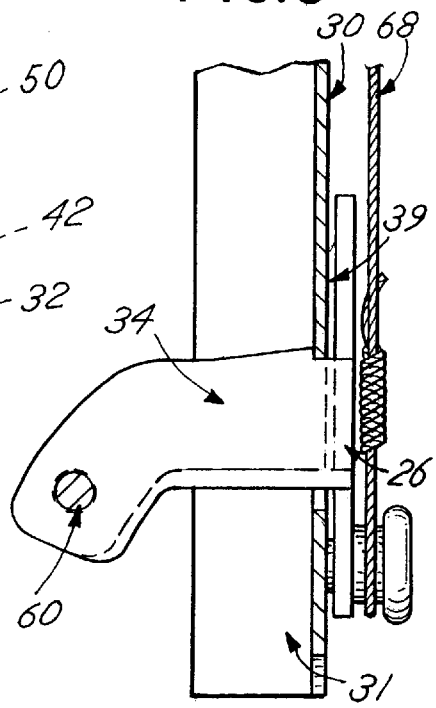
FIG. 6 is a cut away side view depicting the orientation of the cable attachment bracket when the cable attachment bracket is inserted and secured within the garage door panel by fastening screws.
Figure 5:
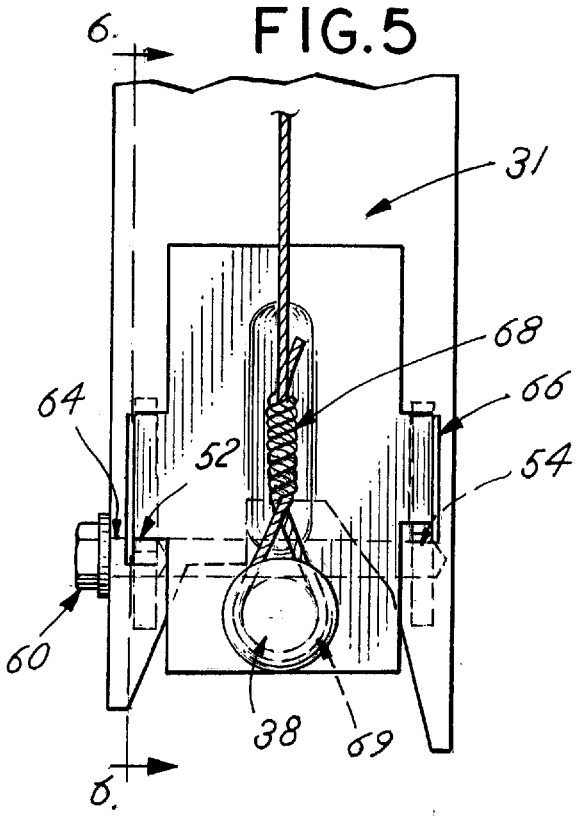
FIG. 5 is an end view of the cable attachment bracket of the present invention installed on a garage door panel and a cable lift.

Referring back to FIG. 3, in use the cable attachment bracket 26 is positioned in the garage door panel by inserting the opposed flanges 34, 36 into formed slots 56, 58 of the end stile 30 and the bottom garage door panel 31 until the channel run 39 contacts the outer surface of the end stile 30 (note that the cable attachment bracket 26 could be secured directly to the bottom garage door panel 31, however, it is preferred to secure the cable attachment bracket 26 to the end stile 30 which, in turn, is secured to the garage door panel 31). As shown in FIG. 6, the channel run 39 contacts the end stile 30 and ensures proper vertical positioning of the cable attachment bracket 26 in relation to the garage door panel. The construction and configuration of the opposed flanges 34, 36 ensure that the cable attachment bracket 26 will not be inadvertently inserted into the garage door panel 31 upside down. Specifically, as shown in FIG. 5, the opposed flange 34 has a slightly longer vertical length than opposed flange 36. This configuration prevents opposed flange 34 from being inserted into the formed slot 58 (as shown in FIG. 3).

Referring to FIGS. 3–5, a fastening screw 60 is inserted through holes 64 in the end stile 30 and the bottom garage door panel 31 and pass through the keyed openings 52, 54 of the angular runs 44, 46. The fastening screw 60 removably connect the cable bracket attachment bracket 26 to the bottom garage door panel 31. A lift cable 68 is then attached to the shoulder stud 38. Preferably, a loop 69 is formed at the end of the lift cable 68 and wrapped around the shoulder stud 38 to removably connect the garage door panel 31 to the garage door counterbalancing mechanism.

Referring back to FIG. 3, after attaching the cable attachment bracket 26 to the bottom garage door panel 31, a bottom roller bracket 70 is removably connected to the bottom garage door panel 31. The bottom roller bracket includes a leaf member 72, upstanding outwardly extending opposed flanges 74, 76 having cylindrical openings 78, 80. The leaf member 72 is secured to the bottom garage door panel 31 by inserting fastening screws 82, 84 into holes 85, 86 formed in the leaf member 72 and passing the fastening screws 82, 84 through corresponding holes 88, 90 formed in the end stile 30 and the bottom garage door panel 31. A cylindrical sleeve 92 with two opposing cylindrical holes 94, 96 aligns within the cylindrical openings 78, 80. A shaped roller 98 is mounted on a cylindrical shaft or rod 100 which fits within the cylindrical sleeve 92 and is retained so that that the bottom roller bracket 70, in combination with the roller 98 and associated shaft 100, supports the bottom garage door panel 31 door on the track.

Figure 7:
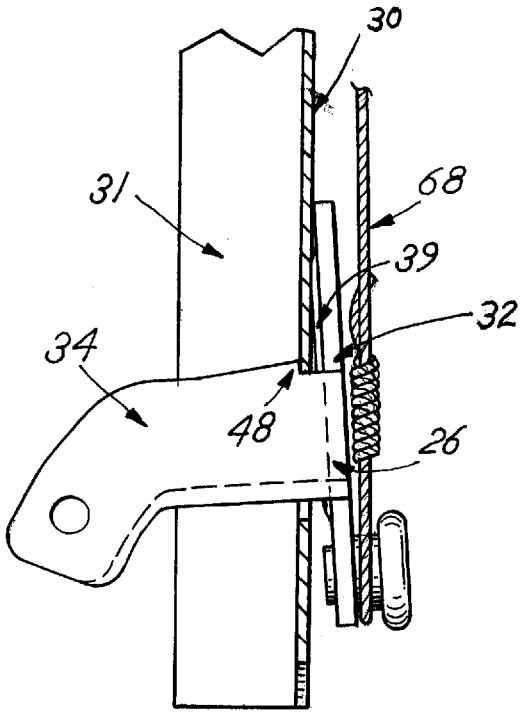
FIG. 7 is a cut away side view depicting the orientation of the cable attachment bracket when the fastening screws that secure the cable attachment bracket to the garage door panel are removed.

Referring to FIGS. 3 and 6–7, the unique construction and positioning of the cable attachment bracket 26 prevents the cable attachment bracket 26 from separating from the garage door while the lift cable 68 is under tension. First, the fastening screws 60 fixedly secures the cable attachment bracket 26 to the bottom garage door panel 31 and prevents the cable attachment member from becoming separating from the bottom garage door panel 31. Furthermore, the construction and configuration of the opposed flanges 34, 36 further prevent the cable attachment bracket 26 from becoming separated from the bottom garage door panel 31 should the fastening screw 60 become removed. As shown in FIG. 7, when the fastening screw 60 (not shown) is removed while the lift cable 68 is under tension, the tension in the lift cable 68 biases the cable attachment bracket 26 in an interlocked position as the retaining notches 48, 50 engage the inner surface of the bottom garage door panel 31 and the upper portion of the central member 32 and the channel run 39 engage the outer surface of the end stile 30. As a result, the cable attachment bracket 26 cannot be separated from the bottom garage door panel 31 without first releasing the tension in the lift cable 68.

In the foregoing specification, the present invention has been described with reference to specific exemplary embodiments thereof. It will be apparent to those skilled in the art, that a person understanding this invention may conceive of changes or other embodiments or variations, which utilize the principles of this invention without departing from the broader spirit and scope of the invention. The specification and drawings are, therefore, to be regarded in an illustrative rather restrictive sense. Accordingly, it is not intended that the invention be limited except as may be necessary in view of the appended claims.

I claim:

1. A bottom garage door panel bracket assembly comprising:

an attachment bracket having a central plate member containing a shoulder rivet, opposed flanges extending inwardly from the central plate member, the opposed flanges positioned in and removably connected to a garage door panel by a fastening device, the opposed flanges containing retaining notches for securing the attachment bracket in the garage door panel when the fastening device is removed; and a bottom roller assembly removably connected to the garage door panel.

2. A bottom garage door panel bracket assembly comprising:

an attachment bracket having a central member containing a shoulder rivet for connection with a garage door counterbalance mechanism, opposed flanges extending inwardly from the central member, the opposed flanges positioned in and removably connected to a garage door panel by a fastening device, the opposed flanges containing retaining notches for securing the attachment bracket in the garage door panel when the fastening device is removed; and a bottom roller assembly removably connected to the end stile.

3. A cable attachment bracket for connecting a garage door to a garage door counterbalancing mechanism comprising:

a cable attachment bracket containing a central member having an inside face and an_outside face; a shoulder rivet extending outwardly from the outside face of the central member for connecting the cable attachment bracket to a garage door counterbalancing mechanism cable; opposed flanges extending inwardly from the inside face of the central member, each flange having a perpendicular run with a retaining notch; an angular run extending from the perpendicular run and being fixedly connected to a garage door panel by a fastening device that passes through a keyed opening formed in the angular run, wherein the retaining notches on the opposed flanges interlock the cable attachment bracket with an inside surface of the garage door panel when the fastening device is removed while the counterbalancing mechanism cable is under tension.

4. A bottom garage door panel bracket assembly comprising:

an end stile fixedly connected to a garage door panel;

a cable attachment bracket positioned in and removably connected to the end stile, the cable attachment bracket containing a central member having an inside face and an outside face;

a shoulder rivet extending outwardly from the outside face of the central member for connecting the cable attachment bracket to a garage door counterbalancing mechanism cable;

opposed flanges extending inwardly from the inside face of the central member, each flange having a perpendicular run with a retaining notch;

an angular run extending from the perpendicular run and being fixedly connected to a garage door panel by a fastening device that passes through a keyed opening formed in the angular run, wherein the retaining notches on the opposed flanges interlock the cable attachment bracket with an inside surface of the garage door panel when the fastening device is removed while the counterbalancing mechanism cable is under tension;

a bottom roller assembly removably connected to the end stile, wherein the bottom roller assembly is independent of the cable attachment bracket.

5. A cable attachment bracket system for connecting a garage door to a garage door counterbalancing mechanism comprising:

an attachment bracket and a fastening device for removably connecting the attachment bracket to a garage door panel;

a means for removably connecting the attachment bracket to a lift cable of a garage door counterbalancing mechanism; and a means for interlocking the attachment bracket with the garage door panel when the fastening member is removed while the lift cable is under tension so as to prevent the attachment bracket from becoming separated from the garage door panel comprising: a bracket having a central member with opposed flanges extending inwardly from the central member and inserted into slots formed on the garage door panel, the opposed flanges having retaining notches located on the upper surface of the opposed flanges, the retaining notches biased toward an interlocked position with an inner surface of the garage door panel by the tension in the lift cable.

* * * * *